United States Patent [19]

Ting

[11] Patent Number: 4,840,004

[45] Date of Patent: Jun. 20, 1989

[54] EXTERNALLY DRAINED WALL JOINT DESIGN

[76] Inventor: Raymond M. L. Ting, 318 Holiday Dr., Pittsburgh, Pa. 15237

[21] Appl. No.: 222,551

[22] Filed: Jul. 21, 1988

[51] Int. Cl.[4] ..... E04H 1/00

[52] U.S. Cl. ..... 52/235; 52/573; 52/582

[58] Field of Search ..... 52/235, 573, 582, 595

[56] References Cited

U.S. PATENT DOCUMENTS 4,021,987 5/1977 Schnebel ..... 52/235 X 4,563,849 1/1986 Mangal ..... 52/235

4,574,546 3/1986 Gartner ..... 52/235

4,599,838 7/1986 Kaminaga ..... 52/235

*Primary Examiner*—David A. Scherbel

*Assistant Examiner*—Anthony W. Williams

*Attorney, Agent, or Firm*—William J. Ruano

[57] ABSTRACT

This invention relates to the water-tight performance of an exterior wall panel system. Each individual wall panel consists of an exterior facing member and four perimeter extrusions. The design prevents the exterior water from reaching the wall joint seals eliminating water leakage without using an internal gutter system and water drainage mechanism is provided within the wall cavities which are pressure equalized to the exterior environmenal air.

9 Claims, 3 Drawing Sheets

EXTERNALLY DRAINED WALL JOINT DESIGN

BACKGROUND OF THE INVENTION

1. Field of the Invention

This invention relates to exterior building wall systems utilizing multiple wall panels forming horizontal and vertical wall joints. Each individual wall panel consists of an essentially flat exterior facing member made of either coated metal plate or finished stone and four perimeter members which are structurally connected to the facing member. The wall joint design of this invention achieves better airtight and watertight performances.

2. Description of the Prior Art

Metal plate and stone wall systems have been used in the exterior wall construction for many years. It is known that there is a substantial air pressure differential between the exterior and the interior of most of the modern buildings. It is a common industrial practice to specify the watertight performance test of a wall system under a differential pressure of 20% of the positive design wind load with a minimum of 6.24 psf simulating a 50 mph wind velocity. In the prior art wall joint designs, the wall joint seals are located on or near the exterior wall surface. These sealant locations are subjected to the exterior running water, therefore, water will infiltrate through the sealant if pin holes exist in the sealant due to the effect of the differential pressure. Therefore, to prevent water from infiltrating through the wall joint, the sealant quality must be perfect (i.e. 100% airtight). However, perfect seal is difficult if not impossible to achieve and to endure due to the variation of workmanship and the relative joint movements produced by wind and thermal loads. Recognizing the difficulty of achieving perfect seal condition, all the successful prior art designs utilized an internal gutter system with drainage holes to collect and to drain the water infiltrated through the wall joints. The design principle of the internal gutter system is to control and to drain the water leaked through the wall joints. The system design is to allow water leakage but to put the leakage under control such that no interior water damage will be caused by the leakage. This condition is known as controlled leakage. The controlled leakage condition is acceptable in the watertight performance test. The drawbacks of the prior art internal gutter system are itemized below.

(1) The drainage holes are the linkages between the interior air and the exterior air and thus they are the source of air leakage which will reduce the thermal efficiency of the building.

(2) If the drainage holes are subjected to the exterior running water, the water will be sucked inwardly through the drainage holes due to the differential pressure. In this case, the drainage holes are the source of water leakage prior to the intended design function of drainage.

(3) Since the drainage holes are linking between the exterior air and the interior air, the water head inside the internal gutter must be built-up to overcome the differential pressure before outward drainage can take place. This gutter water head necessitates the following three design considerations. First, the gutter leg height must be larger than the expected water head to prevent overflow. Second, the butt joint of the internal gutter are more vulnerable to uncontrolled leakage due to the water head effect. Third, sustained differential pressure means that the water inside the internal gutter can only be dried out by evaporation resulting in maintaining a high relative humidity in the wall cavity. Therefore, a vapor barrier is normally used to protect the insulation installed behind the internal gutter system adding to the cost.

(4) Since the internal gutter is open on the interior side, the drainage holes are vulnerable to clogging due to the deposit of foreign materials during the interior construction. For example, it is often that the interior fireproof spraying is executed after the enclosure of the exterior wall. In this case, it is often to see that the internal gutter system is clogged by the overspray of the fire proofing material.

(5) Due to the effect of the differential pressure, the size of the drainage hole must be substantial for effective drainage. The larger the drainage hole, the better the drainage function. However, the smaller the drainage hole, the better the thermal efficiency. Apparently, the internal gutter system has created the above two contradicting design objectives.

(6) When the exterior air is being sucked through the drainage holes and the water inside the internal gutter, it creates the same effect of boiling water in which some water drops may jump out of the internal gutter system and become uncontrollable. To lessen this effect, the prior art designs utilized either a baffle block or a shielding plate at the location of every drainage hole.

SUMMARY OF THE INVENTION

It is obvious that no leakage is better than controlled leakage. The objective of this invention is to provide a wall joint design which will change the controlled leakage condition of the prior art systems to a no leakage condition eliminating all the drawbacks of the prior art systems. In order to explain the working principles of this invention, the folowing new terminologies are required.

(1) Differential Seal: A sealant line between two spaces having a significant differential pressure. The sealant lines bordering the interior air are considered as differential seals.

(2) Moving Joint: A joint between two wall components that is subjected to a significant relative movement due to thermal and/or wind loads.

(3) Non-moving Joint: A joint between two wall components that is subjected to an ignorable relative movement due to thermal and/or wind loads.

(4) Rain Screen: A device in front of a wall cavity to provide a shield to prevent rain water from dropping or splashing into the wall cavity.

(5) Wall Cavity: A cavity inside the wall joint between the exterior wall surface and the interior wall joint seal.

The main design features of this invention include the following items.

(1) The differential seals of the wall joints are located as far as possible from the exterior wall surface so that the wall cavity is maximized.

(2) A rain screen is installed within the wall cavity to separate the wall cavity into an outer cavity and an inner cavity. The outer cavity is utilized to prevent the majority of the exterior water from entering the inner cavity. The inner cavity is pressure equalized to the exterior air and has a drainage system to prevent water from reaching the differential seals of the wall joints.

In the above arrangements, since no water will reach the differential seals of the wall joints, any imperfection in the seals will not result in water leakage. At the same time, since the drainage holes within the inner cavity do not link between the exterior air and the interior air, the system is externally drained eliminating all the drawbacks of the internally drained prior art systems. The design functions of the present invention will become apparent in the explainations of the preferred embodiments.

DESCRIPTION OF THE PREFERRED EMBODIMENTS

Figure 1:
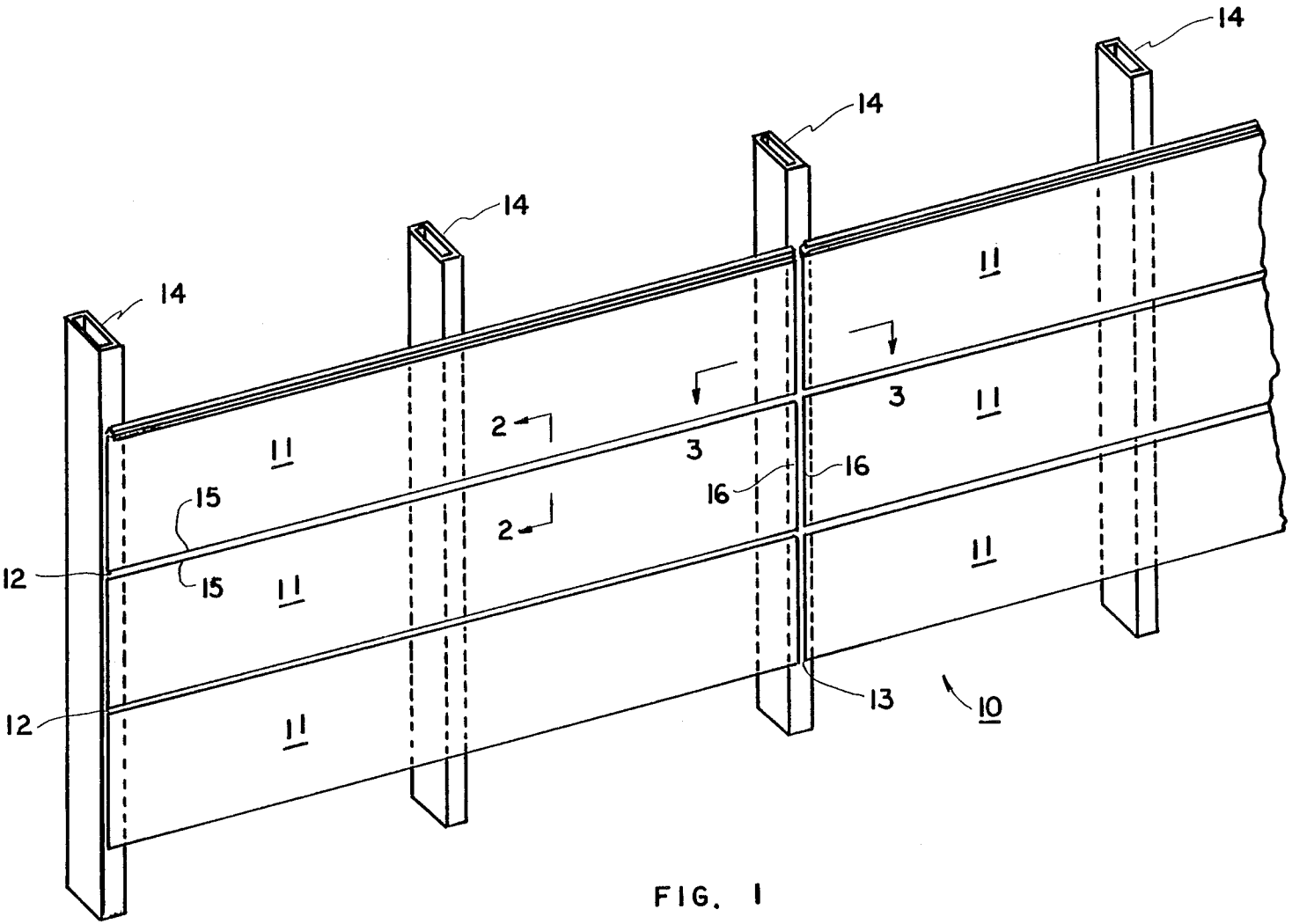
FIG. 1 is an isometric view illustrating a portion of the exterior wall system of the invention.

FIG. 1 illustrates an exterior wall structure 10 consisting of multiple wall panels 11 joined together along the panel horizontal edges 15 to form the horizontal wall joints 12 and along the panel vertical edges 16 to form the vertical wall joint 13. The wall panels 11 are securely fastened to the spaced apart wall supporting members 14 which are fastened to the building perimeter frame which is not shown.

Figure 2A:
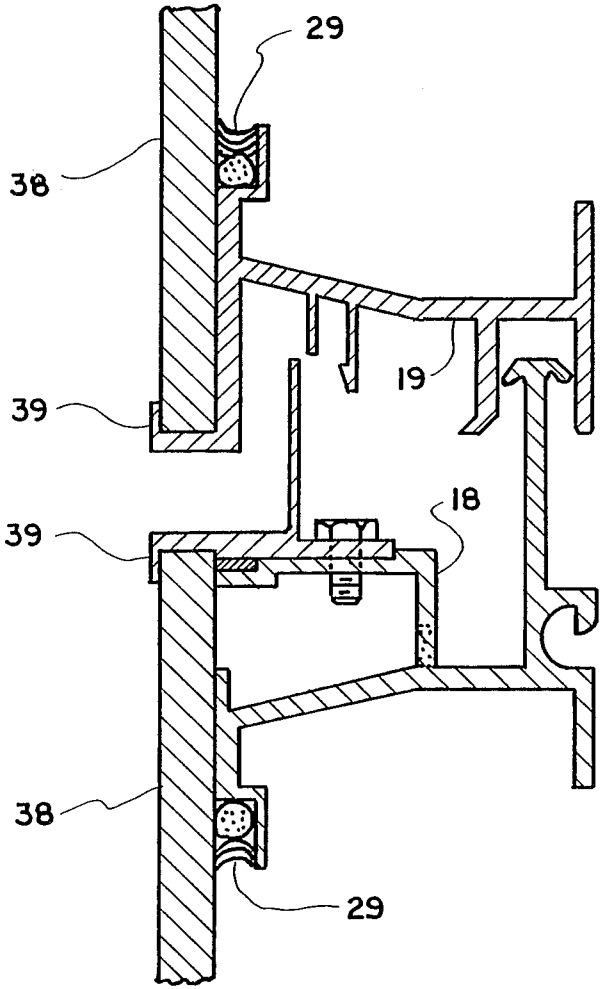
FIG. 2*a* is a variation of FIG. 2 in which an exterior facing stone or precasted concrete panel is used.
Figure 2:
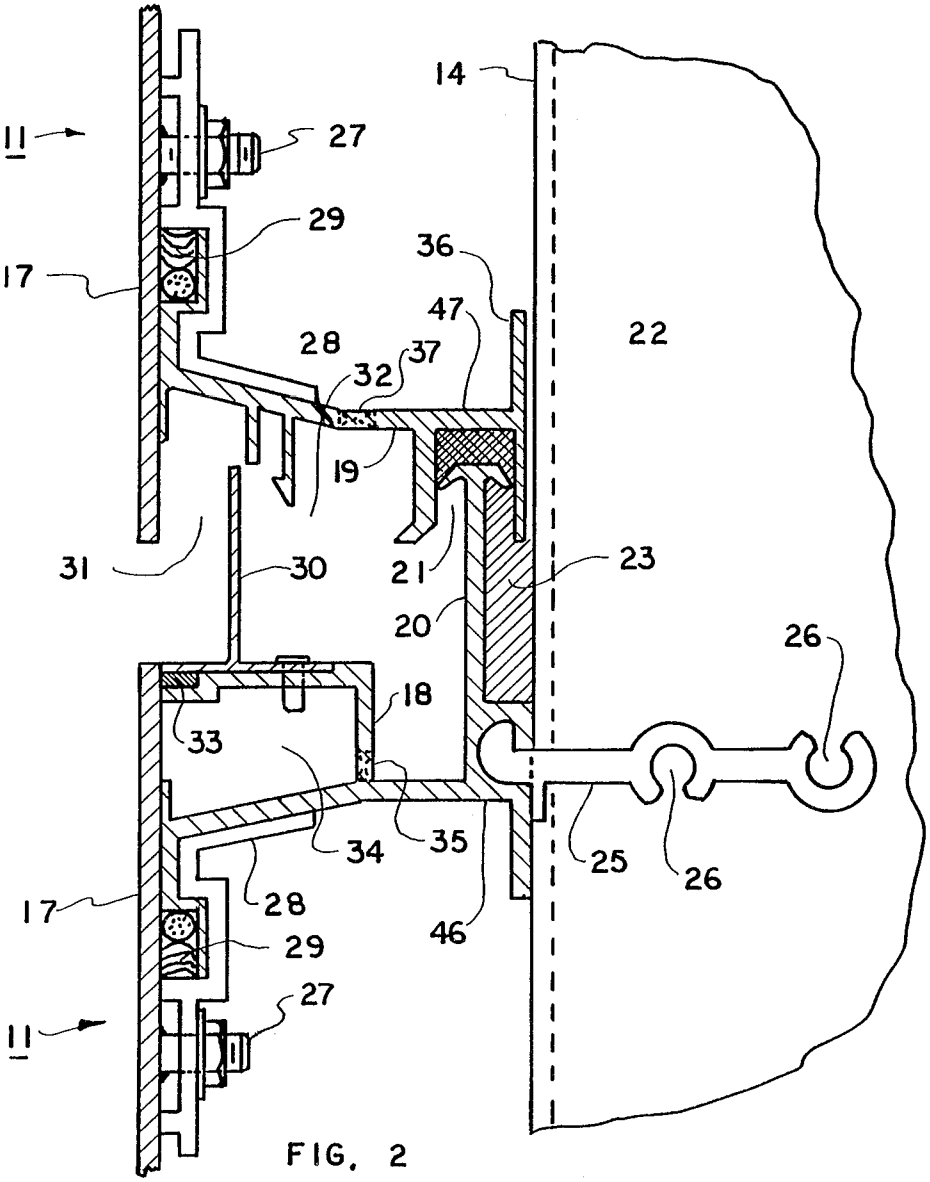
FIG. 2 is a typical fragmentary cross-sectional view taken along line 2—2 of FIG. 1 showing the horizontal wall joint of the invention in which an exterior metal facing plate is used.

FIG. 2 shows a typical fragmentary cross-section of the horizontal wall joint 12 taken along line 2—2 of FIG. 1. Each wall panel has an exterior facing metal plate 17, a top perimeter member 18, and a bottom perimeter member 19. The top perimeter member 18 has a male horizontal joint spline 20 located near the supporting member 14 to cause the structural engagement with the female joint 21 of the bottom perimeter member 19 of the upper panel 11. The perimeter members 18 and 19 are made of extruded aluminum. The interlocked horizontal joint is sealed by seal 22. The marriage seal 23 is provided at the panel end to bridge between the horizontal seal 22 and the vertical seal 24 shown in FIG. 3. The wall panel 11 is secured to the supporting member 14 at the top perimeter member 18 using a clip 25 having fastening holes 26. The perimeter extrusions 18 and 19 are structurally connected to the facing plate 17 using spaced apart welded studs 27 and extrusion clips 28 and sealed in between by continuous perimeter seal 29. A horizontal joint rain screen member 30 is provided to separate the horizontal wall cavity into an outer horizontal cavity 31 and an inner horizontal cavity 32. As shown, the rain screen member 30 is a separate member fastened to the top perimeter member 18 and sealed to the exterior facing plate 17 using seal 33. The rain screen 30 can be an integral part of the top perimeter extrusion 18. However, separate arrangement as shown is preferred due to the easiness of painting the exposed surfaces and notching at the corners to prevent interference with the vertical joint arrangement. When the exterior water is running down along the exterior wall surface, the majority of the water will be kept in front of the rain screen 30. A small amount of water may splash over the rain screen 30 and enter into the inner horizontal cavity 32. The small amount of water entered into the inner horizontal cavity will be drained into the concealed horizontal cavity 34 through the drainage hole 35. The concealed horizontal cavity 34 is open to the exterior at the vertical wall joint 13. Since there is no air seal at the top of the rain screen 30, the inner horizontal cavity 32 is pressure equalized to the exterior air and thus the drainage through the hole 35 is not subjected to the problems caused by differential pressure of the prior art systems. It is also clear that the water inside the inner horizontal cavity 32 will not be build-up to reach the differential seal 22, therefore, any imperfection in the seal 22 will not cause water infiltration into the building interior. It is also clear that the drainage system is concealed from the interior eliminating the clogging problem of the prior art systems. A gutter leg 36 is also provided on the bottom perimeter extrusion 19 to collect the back side condensatin water of the facing plate 17. The amount of water due to condensation is normally expected to be small and it can normally be expected to dry out by evaporation without using drainage holes. In a very humid environment, it may be desirable to provide the drainage hole 37. In this case, the drainage hole 37 is subjected to the differential pressure. However, since the drainage hole 37 is used to handle the small amount of condensation water only, the hole size can be minimized and the effect on the thermal efficiency of the building is expected to be minimal.

FIG. 2*a* is a variation of FIG. 2 in which the exterior facing member 38 is either a natural stone or a precasted concrete panel. Instead of using the welded studs 27 and extrusion clips 28 as shown in FIG. 2, the stone or concrete facing panel 38 is structurally connected to the perimeter extrusions 18 and 19 using the profiled hocking device 39. All the other functional designs are the same as explained in FIG. 2.

Figure 3A:
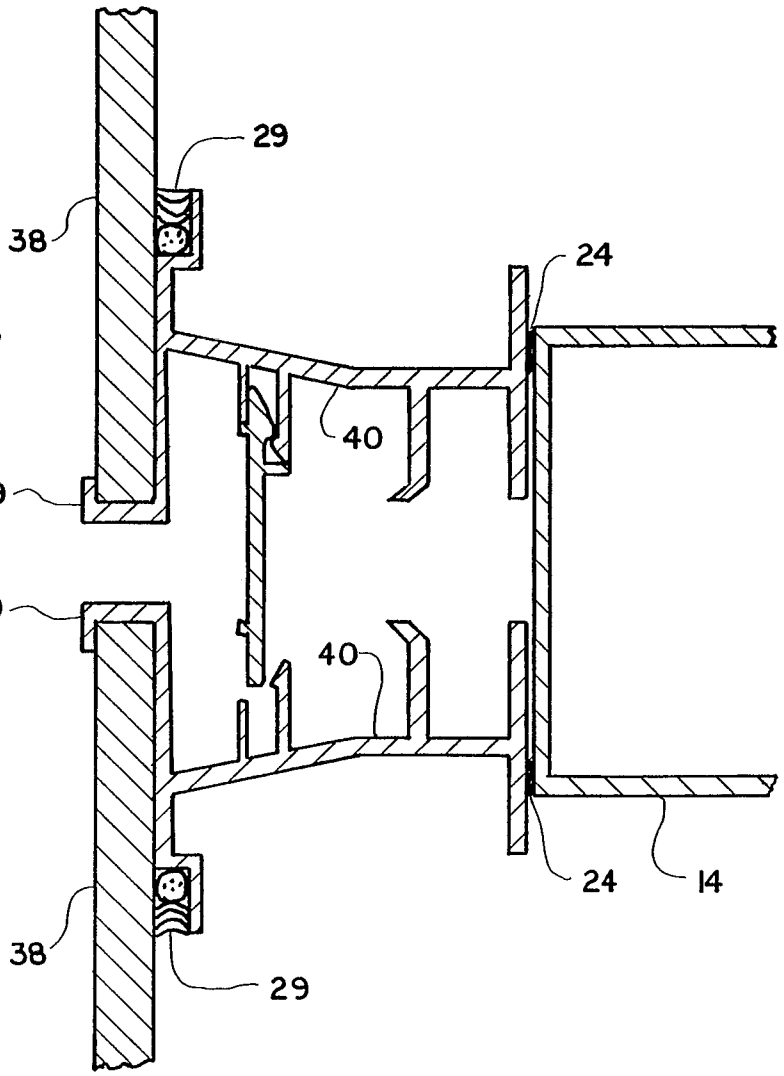
FIG. 3*a* is a variation of FIG. 3 in which an exterior facing stone or precasted concrete panel is used.
Figure 3:
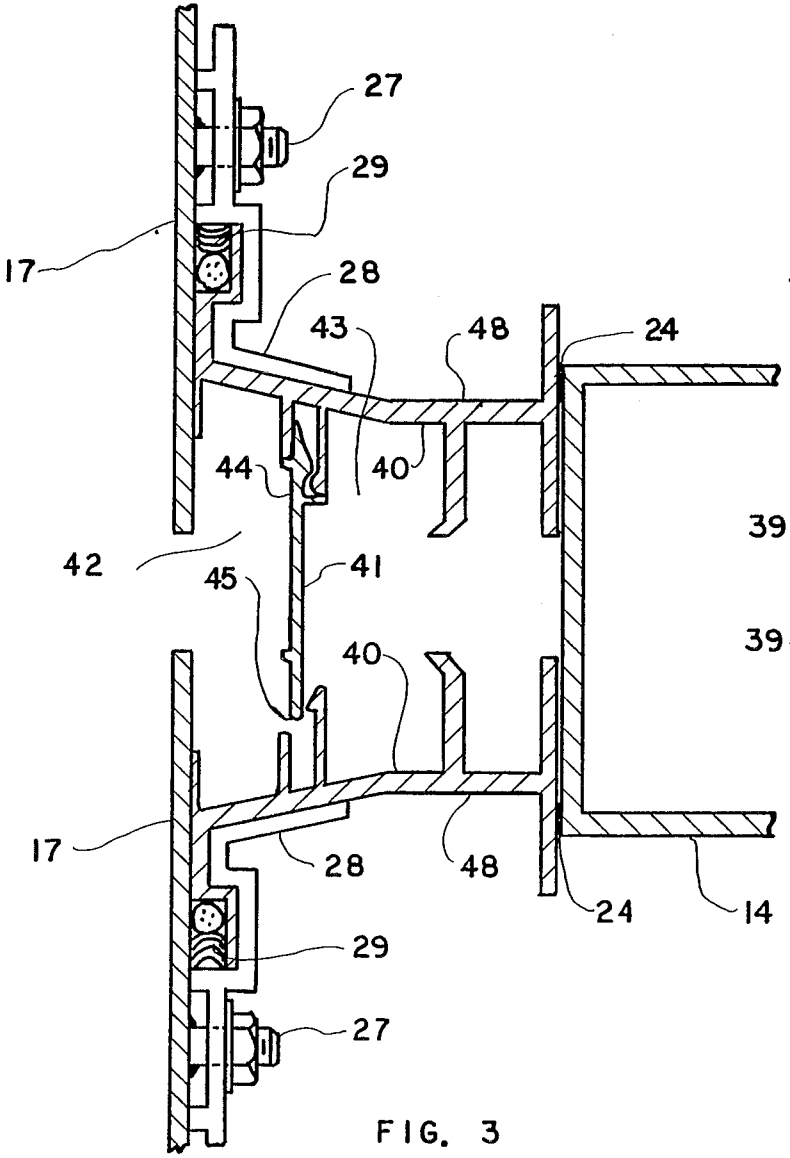
FIG. 3 is a typical fragmentary cross-sectional view taken along line 3—3 of FIG. 1 showing the vertical wall joint of the invention in which an exterior metal facing plate is used.

FIG. 3 shows a typical fragmentary cross section of the vertical wall joint 13 taken along line 3—3 of FIG. 1. The panel side perimeter extrusions 40 are extended to the vicinity of the supporting member 14. The continuous vertical wall joint seals 24 are provided between the supporting member 14 and the side perimeter extrusions 40. Similar to the top and the bottom perimeter extrusions, welded studs 27 and extrusion cips 28 are used to structurally connect the facing metal plate 17 to the side perimeter extrusions 40 and sealed in between by the continuous perimeter seal 29. A vertical joint rain screen member 41 is installed inside the vertical wall cavity to separate the vertical wall cavity into an outer vertical cavity 42 and an inner vertical cavity 43. It is desirable to position the vertical joint rain screen 41 right behind the horizontal joint rain screen 30 so that the vertical joint rain screen 41 can be installed without interference through multiple panel heights. The vertical joint rain screen 41 is secured to the side perimeter extrusion 40 on one edge 44 and free on the other edge 45 to allow for thermal movement of the vertical wall joint 13. From the construction shown, it becomes apparent that the majority of the exterior water will be kept in front of the rain screen 41 within the outer vertical cavity 42 and a small amount of water may be forced around the rain screen 41 into the inner vertical cavity 43 by wind forces. It is also apparent from the construction shown that the water entered into the inner vertical cavity 43 will drain downwardly to the bottom end of the vertical wall joint 13 for eventual drainage to the outside without the possibility of water reaching the differential vertical seal 24. Therefore, any imperfection in the vertical seal 24 will not cause water leakage. Since no air seal is provided along the edges of the vertical rain screen 41, the air pressure inside the inner vertical cavity 43 is equalized to the exterior air, therefore, the amount of water entering into the inner vertical cavity 43 can be expected to be minimal.

FIG. 3*a* is a variation of FIG. 3 in which element 38 represents a natural stone or a precasted concrete panel. Instead of using the welded studs 27 and the extrusion clips 28 as shown in FIG. 3, the facing panel 38 is structurally connected to the side perimeter extrusions 40 using the profiled hocking device 39. All the other functional designs are the same as explained in FIG. 3.

Reviewing FIG. 2 and FIG. 3 concurrently, it becomes apparent that it is desirable to maintain the same profile for the inner surface 46 of the top perimeter extrusion 18, the inner surface 47 of the bottom perimeter extrusion 19, and the inner surface 48 of the side perimeter extrusion 40 so that all corners can be miter-matched fo easy sealing. For the same reason, the perimeter seal 29 can be easily made to be continuous around the corners. In this manner, the assembled wall panel 11 consists of a frontal face member and four miter-matched perimeter extrusions resembling a framed picture. The seals at the mitered corners and the perimeter seal 29 are diferential seals and will be subjected to some exterior water. However, the seals are shop applied at these locations and the joints can be classified as non-moving joints and thus, enduring perfect seals at these locations can be expected by design. If a layer of insulating material is installed behind the exterior facing member, the water condensation problem can be eliminated. Any concern of water leakage through the perimeter seal 29 and the corner seals can be eliminated if poured-in-place closed cell insulating foam is used behind the frontal facing member and confined by the perimeter extrusions 18, 19, and 40.

While I have illustrated and described several embodiments of my invention, it will be understood that these are by way of illustration only and that various changes and modifications may be contemplated in my invention and within the scope of the following claims.

I claim:

1. In an exterior building panel wall assembly formed from individual wall panels secured to spaced apart wall supporting members, each said wall panel having essentially parallel top and bottom horizontal edges and two essentially parallel vertical side edges, said wall panels being joined along said horizontal edges to form horizontal wall joints and along said vertical edges to form vertical wall joints, each said wall panel comprising an essentially flat exterior facing member and four interior perimeter extrusions including one top perimeter extrusion, one bottom perimeter extrusion, and two side perimeter extrusions, said perimeter extrusions being connected to said facing member by structural connecting means and sealed in between, a horizontal wall cavity being formed at each said horizontal wall joint between said top perimeter extrusion and said bottom perimeter extrusion across said horizontal wall joint, a vertical wall cavity being formed at each said vertical wall joint between said side perimeter extrusions across said vertical wall joint; the improvement comprising a horizontal rain screen member installed within said horizontal wall cavity separating said horizontal wall cavity into an outer horizontal cavity and an inner horizontal cavity, an upstanding male joint spline behind said inner horizontal cavity in said top perimeter extrusion, a horizontal female joint in said bottom perimeter extrusion to cause engagement with said male joint spline, a vertical rain screen member installed within said vertical wall cavity separating said vertical wall cavity into an outer vertical cavity and an inner vertical cavity, said outer horizontal cavity and said outer vertical cavity being interconnected to form an outer cavity, said inner horizontal cavity and said inner vertical cavity being inter-connected to form an inner cavity, at least one drainage hole being provided near the bottom of said inner horizontal cavity allowing water drainage from said inner cavity to said outer cavity, a horizontal seal being provided in said horizontal female joint, a vertical seal being provided between said side perimeter extrusion and said wall supporting member, marriage seal being provided between said horizontal seal and said vertical seal, corner seals being provided at the intersecting corners of said perimeter extrusions.

2. The exterior facing member of claim 1 being a metal plate wherein said structural connecting means comprising spaced apart welded studs on said metal plate with extruded aluminum clips hocking onto said perimeter extrusions.

3. The exterior facing member of claim 1 being a natural stone wherein said structural connecting means being provided by a hocking profile in said perimeter extrusions to hock onto the edges of said natural stone.

4. The exterior facing member of claim 1 being a precasted concrete panel wherein said structural connecting means being provided by a hocking profile in said perimeter extrusions to hock onto the edges of said precasted concrete panel.

5. The improvement of claim 1 wherein said bottom perimeter extrusion having an upstanding leg to contain water condensated on the interior surface of said exterior facing member.

6. The improvement of claim 5 wherein said botom perimeter extrusion having at east one drainage hole for draining condensation water into said inner horizontal cavity below.

7. The improvement of claim 1 wherhein said top perimeter extrusion, said botom perimeter extrusion, and said side perimeter extrusion having a miter-matched inner surface profile.

8. The improvement of claim 1 wherein each said panel having a layer of thermal insulating material installed behind said exterior facing member and confined by said perimeter extrusions.

9. The improvement of claim 8 wherein said insulating material being closed cell insulating foam installed by foamed-in-place process.

* * * * *